US009027645B2

(12) United States Patent
Moidel et al.

(10) Patent No.: US 9,027,645 B2
(45) Date of Patent: May 12, 2015

(54) FISHING TOOL

(75) Inventors: Joe Phillip Moidel, Houma, LA (US); Jimmy D. Ryan, Houma, LA (US); Clyde F. Akers, Parks, LA (US); James A. Sonnier, Houston, TX (US); Eric P. Rogers, Houma, LA (US)

(73) Assignee: Baker Hughes Incorporated, Houston, TX (US)

( * ) Notice: Subject to any disclaimer, the term of this patent is extended or adjusted under 35 U.S.C. 154(b) by 897 days.

(21) Appl. No.: 13/207,880

(22) Filed: Aug. 11, 2011

(65) Prior Publication Data

US 2012/0037369 A1 Feb. 16, 2012

Related U.S. Application Data

(60) Provisional application No. 61/374,149, filed on Aug. 16, 2010.

(51) Int. Cl.
*E21B 31/00* (2006.01)
*E21B 31/18* (2006.01)

(52) U.S. Cl.
CPC ..... *E21B 31/18* (2013.01)

(58) Field of Classification Search
CPC ..... E21B 31/18; E21B 31/00; E21B 31/20; E21B 31/125; E21B 31/007
USPC ..... 166/301, 98, 241.6, 241.69, 99; 294/86.34
See application file for complete search history.

(56) References Cited

U.S. PATENT DOCUMENTS 1,527,413 A 2/1925 Hinderliter
1,707,072 A 3/1929 Black
1,745,274 A 1/1930 Sauls
1,754,696 A 4/1930 Sauls
1,763,703 A 6/1930 Hinderliter
1,773,962 A 8/1930 Davis
1,776,027 A 9/1930 Hinderliter
1,791,529 A 2/1931 Lamoureaux et al.
1,797,505 A 3/1931 Jones et al.

(Continued)

FOREIGN PATENT DOCUMENTS

JP 63-272887 A 11/1988
JP 07-252987 A 10/1995
WO WO 97-19248 A2 5/1997

OTHER PUBLICATIONS

International Search Report, Feb. 9, 2012, pp. 1-3, PCT/US2011/047508, Korean Intellectual Property Office.

(Continued)

*Primary Examiner* — Kenneth L Thompson
*Assistant Examiner* — Michael Wills, III
(74) *Attorney, Agent, or Firm* — Parsons Behle & Latimer

(57) ABSTRACT

Fishing tools for retrieving objects, i.e., "fish," lodged within a wellbore are disclosed. The fishing tool comprises a tubular member having a tubular member bore with at least one profiled surface or insert disposed within or along the inner wall surface of the tubular member bore. The profiled surface or insert provides a fishing profile shaped to allow a portion of the fish to move past the fishing profile so that the fishing profile is disposed below the portion of the fish. The tubular member can then be actuated, such as through rotation, to align the portion of the fish with a shoulder of the fishing profile. Upward movement of the tool engages the shoulder with the portion of the fish. Continued upward movement of the tool facilitates retrieval of the fish from the wellbore.

17 Claims, 5 Drawing Sheets

(56) References Cited

U.S. PATENT DOCUMENTS

| | | | | | |
|---|---|---|---|---|---|
| 1,825,025 | A | | 9/1931 | Thomas et al. | |
| 2,128,430 | A | | 8/1938 | Pryor | |
| 2,250,463 | A | * | 7/1941 | Boynton | 403/13 |
| 2,272,529 | A | | 2/1942 | Larson | |
| 2,665,164 | A | | 1/1954 | Spang | |
| 3,082,831 | A | * | 3/1963 | Bus, Sr. | 294/86.34 |
| 3,265,135 | A | * | 8/1966 | Wilkinson | 166/240 |
| 3,380,528 | A | | 4/1968 | Timmons | |
| 3,393,002 | A | * | 7/1968 | Woolley | 294/86.23 |
| 4,548,437 | A | | 10/1985 | Driskill | |
| 4,801,167 | A | | 1/1989 | Driskill | |
| 4,817,716 | A | | 4/1989 | Taylor et al. | |
| 5,054,832 | A | | 10/1991 | Davis et al. | |
| 5,054,833 | A | | 10/1991 | Bishop et al. | |
| 5,887,925 | A | | 3/1999 | Arterbury et al. | |
| 5,984,009 | A | * | 11/1999 | DiFoggio | 166/250.13 |
| 6,315,047 | B1 | | 11/2001 | Deaton et al. | |
| 6,564,885 | B2 | * | 5/2003 | Attwater | 175/235 |
| 7,503,388 | B2 | | 3/2009 | Fay et al. | |
| 7,578,348 | B2 | | 8/2009 | Fay | |
| 8,347,964 | B2 | * | 1/2013 | Fisher et al. | 166/301 |
| 2006/0278404 | A1 | | 12/2006 | Fay | |
| 2008/0066914 | A1 | | 3/2008 | Fay | |
| 2008/0099205 | A1 | | 5/2008 | Fay | |

OTHER PUBLICATIONS

Written Opinion of the International Searching Authority, Feb. 9, 2012, pp. 1-3, PCT/US2011/047508, Korean Intellectual Property Office.

Notification Concerning Transmittal of International Preliminary Report on Patentability, Feb. 28, 2013, pp. 1-5, PCT/US2011/047508, Korean Intellectual Property Office.

Bowen Tools, Inc., Instruction Manual Bowen Series 150 Releasing and Circulating Overshot, May 1992, pp. 1-11, Twenty-Third Publishing, USA.

* cited by examiner

FISHING TOOL

RELATED APPLICATION

This application claims the benefit of U.S. Provisional Patent Application Ser. No. 61/374,149, filed Aug. 16, 2010.

BACKGROUND

1. Field of Invention

The invention is directed to tools for retrieving an object disposed in the bore of a well, and in particular, to overshot fishing tools.

2. Description of Art

It is common for objects, such as a segment of a pipe, to become stuck or forcibly lodged within a wellbore. In order for these objects to be removed from the wellbore, various fishing tools have been developed for the purpose of latching onto and retrieving the object, referred to in the industry as the "fish," from the wellbore. One type of fishing tool is known as an overshot fishing tool because the tool is disposed over at least a portion of the object, or fish, disposed within the bore of the well. Such overshot fishing tools are generally known in the art. Other types of fishing tools that function by gripping the lumen of the fish, e.g., the inner diameter of a segment of pipe of the fish. Regardless of type of fishing tool, after the fish is gripped by the fishing tool, the fishing tool and the fish are transported to the surface of the well.

SUMMARY OF INVENTION

Broadly, the fishing tools disclosed herein comprise a tubular member having a fishing profile disposed within or secured to the inner wall surface of the tubular member. The fishing profile is shaped to allow a portion of the fish to move past the fishing profile so that the fishing profile is disposed below the portion of the fish. The tubular member can then be actuated, such as through rotation, to align the portion of the fish with a shoulder of the fishing profile. Upward movement of the tool engages the shoulder with the portion of the fish. Continued upward movement of the tool facilitates retrieval of the fish from the wellbore.

In the event that it is desired to release the fish from the fishing tool, the tubular member can be actuated a second time, such as through rotation, to move the shoulder of the fishing profile out of alignment with the portion of the fish. The tubular member can then be moved upward causing the portion of the fish to move past the fishing profile causing the fishing tool to move off the fish.

In one particular embodiment, the fishing profile comprises two shoulders disposed opposite each other along the inner wall surface of the tubular member with pathways disposed between the ends of the two shoulders. In other particular embodiments, the upper ends of the shoulders comprise a vertical stop member for engaging the fish during rotation of the tubular member. Thus, the vertical stop member provides the function of indicating when the fish is out of alignment with the shoulders so that the fishing tool can be moved off the fish. In still other embodiments, the lower ends of the shoulders comprise guides to facilitate aligning a portion of the fish with at least one of the pathways.

Figure 1:
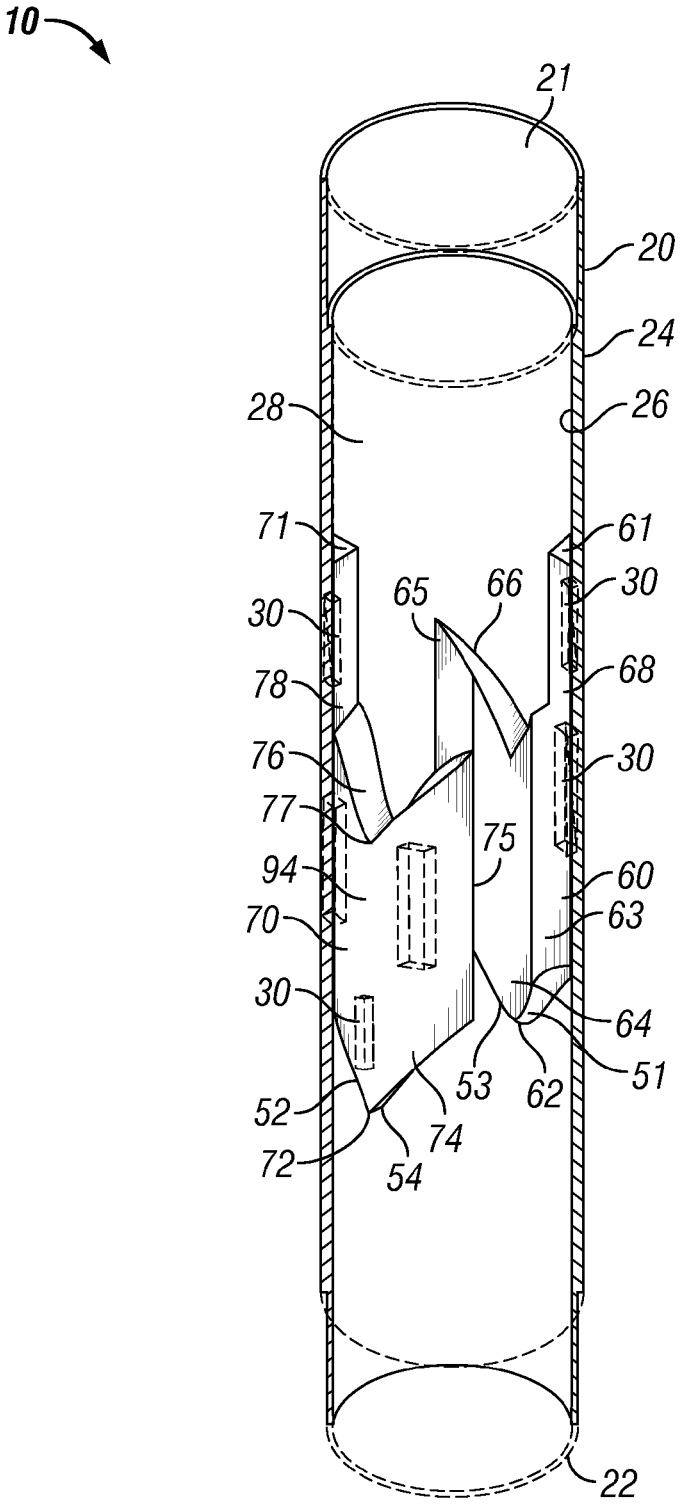
FIG. 1 is a perspective semi-transparent view of one specific embodiment of a fishing tool disclosed herein.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Broadly, the invention is directed to a fishing tool and in particular to a fishing tool which is a type of overshot tool. The fishing tool comprises profiled surfaces disposed on the inner wall surface of a tubular member. The profiled surfaces may be machined directly into the inner wall surface of the tubular member, or as discussed in greater detail below, one or more inserts may be separated formed and then secured to the inner wall surface of the tubular member.

Whether directly machined into the inner wall surface of the tubular member or formed as an insert that is then secured to the inner wall surface of the tubular member, the shape of the profiled surfaces (or inserts) facilitate catching a "fish" or object within the wellbore so that the fish can be removed from the wellbore. The profiled surfaces or inserts are disposed along the inner wall surface of the tubular member to provide pathways between each of the profiled surfaces or inserts. In one embodiment, each profiled surface or insert comprises a fishing or catch profile disposed toward an upper end, a guide disposed toward a lower end, and a release indicator member or stop member that is an extension along one side of the profiled surface or insert. The guide facilitates placement of the "fish" within the space or pathway between the two or more profiled surfaces or inserts and the catch profile receives and secures the "fish" to the profiled surface or insert. The release indicator member provides a signal to an operator at the surface of the wellbore when the fishing tool has released the "fish." As will be understood by persons in the art, the fishing tools disclosed herein permit operation using mechanical input and do not require pumping, fluid flow, or pressure. However, in certain embodiments, pumping, fluid flow, or pressure also can be included to actuate the fishing tools disclosed herein.

In one particular embodiment, the fishing tools disclosed herein permit the fishing tool to remove pipe with flared, "egged," or oblong fish profiles from a wellbore in one trip without the need to dress-off the fish top using traditional milling methods. In one operation of these fishing tools, drill pipe that has been sheared-off after activation of blowout preventer shear rams can be "fished" out of the wellbore. In addition, the fishing tools described herein also can be used to fish any downhole equipment that has a flared fish profile or other fish profile that can be engaged with the fishing or catch profile. As used herein, a flared fish profile is any geometry that is uniform along the axial direction but changes on top by having a wider dimension in one radial direction and a narrower dimension in another radial direction.

Referring now to Figures, in one particular embodiment, fishing tool 10 comprises tubular member 20 having upper end 21, lower end 22, outer wall surface 24, inner wall surface 26, and bore 28. Attachment members such as threads (not shown) can be disposed along inner wall surface 24 adjacent to upper end 21 and along outer wall surface 26 adjacent to lower end 22 to facilitate securing fishing tool 10 to a work string (not shown). In the embodiment discussed with respect to FIGS. 1-7, two inserts 60, 70 are secured to inner wall surface 26.

As shown in FIGS. 1, 2, 5 and 6, slots 30 are cut into tubular member 20 through which bolts or other attachment members secure inserts 60, 70 to tubular member 20. After securing insert 60, 70 to tubular member 20, slots 30 are filled through any method or device known in the art, such as through welding. Although slots 30 and attachment members are used to secure inserts 60, 70 to tubular member in the embodiments of FIGS. 1, 2, 5, and 6, it is to be understood that inserts 60, 70 may be machined cut into inner wall surface 24 such that the function of inserts 60, 70 can be performed by these profiled surfaces (not shown). In other words, the shapes and dimensions of inserts 60, 70 that are discussed in greater detail below can be cut directly into the inner wall surface 24 of tubular member 20.

Figure 2:
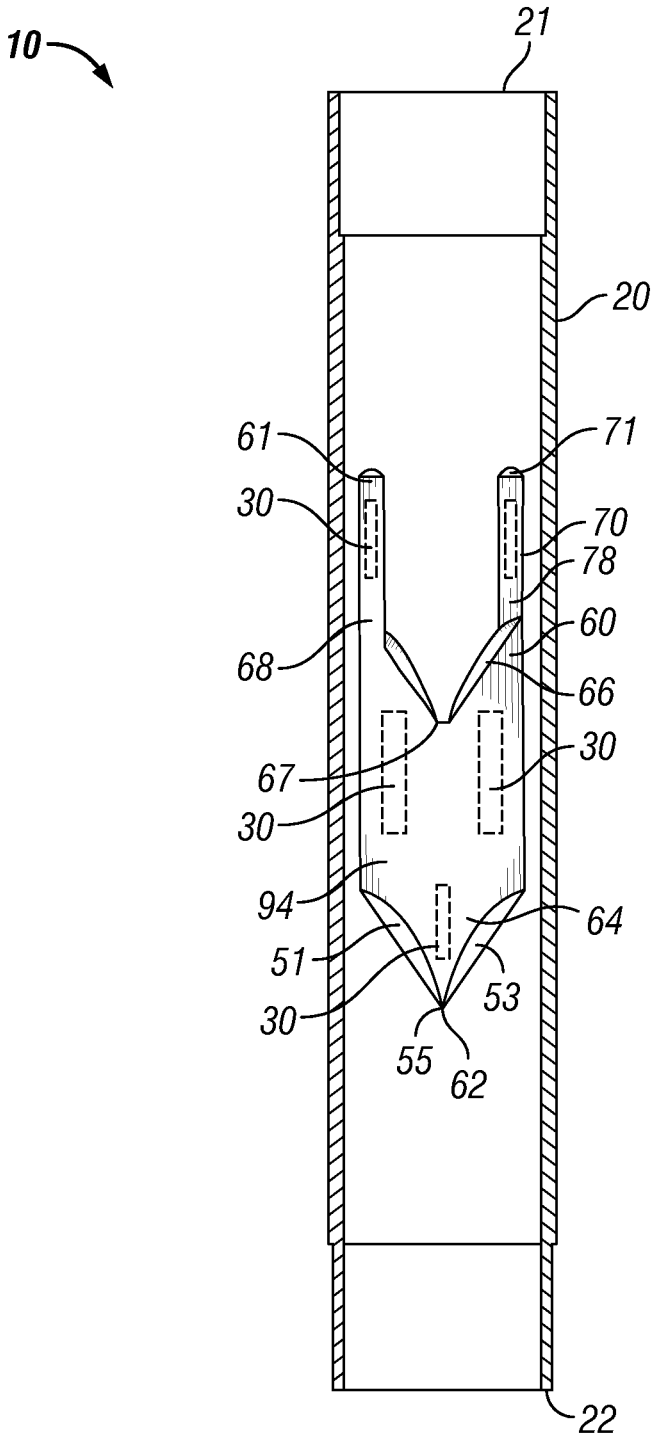
FIG. 2 is a partial cross-sectional view of the fishing tool shown in FIG. 1.

In the embodiments shown in FIGS. 1-3, inserts 60, 70 are identical to each other and are disposed relative to each other to provide pathways 80. As shown in the embodiments of FIGS. 1-3, inserts 60, 70 comprise arcuate bodies comprising upper ends 61, 71, lower ends 62, 72 having guides 64, 74 disposed respectively thereon, first sides 63, 73, second sides 65, 75, inner wall surfaces 69, 79, outer wall surfaces 94, 98, and fishing or catch profiles 66, 76. Guides 64, 74 facilitate orientating fishing tool 10 over an object or fish disposed in the wellbore by guiding inserts 60, 70 around the fish until fishing tool 10 can be positioned over the fish. As shown in the embodiment of FIGS. 1-3, guide 64 comprises intersecting wall surfaces 51, 53 that intersect with one another at point 55. Similarly, in the embodiment of FIGS. 1-3, guide 74 comprises intersecting wall surfaces 52, 54 that intersect with one another at point 56.

In the embodiment of FIGS. 1-3, catch profiles 66, 76 comprise shoulders each having a concave shape. In the embodiments of FIGS. 1-3, the concave shape comprises a V-shape with a "flat" valley 67, 77. The V-shape may provide an angle in the range from about 60 degrees to about 90 degrees. As discussed in greater detail below, fishing or catch profiles 66, 76 facilitate engagement with a fish disposed in the wellbore so that the fish can be moved up and, if desired, out of the wellbore.

Also in the embodiments shown in FIGS. 1-3, inserts 60, 70 include stop members or release indicator elements 68, 78. As shown in the embodiments of FIGS. 1-3, stop members or release indicator elements 68, 78 comprise vertical shaft members disposed along one side of inserts 60, 70. As discussed in greater detail below, release indicator elements 68, 78 facilitate notification to the operator of fishing tool 10 that fishing tool 10 has been orientated with respect to the fish such that fishing tool 10 can be moved off of the fish.

As shown in the embodiments of FIGS. 1-3, inserts 60, 70 comprise arcuate bodies in which inner wall surfaces 69, 79 have a concave shape and outer wall surfaces 94, 98 have a convex shape. Thus, both inner wall surfaces 69, 79 and outer wall surfaces 94, 98 comprises a radius of curvature. The inner wall surfaces 69, 79 may comprise a first radius of curvature and a second radius of curvature, respectively. The first radius of curvature may equal the second radius of curvature. As outer wall surfaces 94, 98 are secured to inner wall surface 26 of tubular member 20, the radii of curvature of outer wall surfaces 94, 98 are substantially identical to a radius of curvature of inner wall surface 26 of tubular member 20.

Figure 3A:
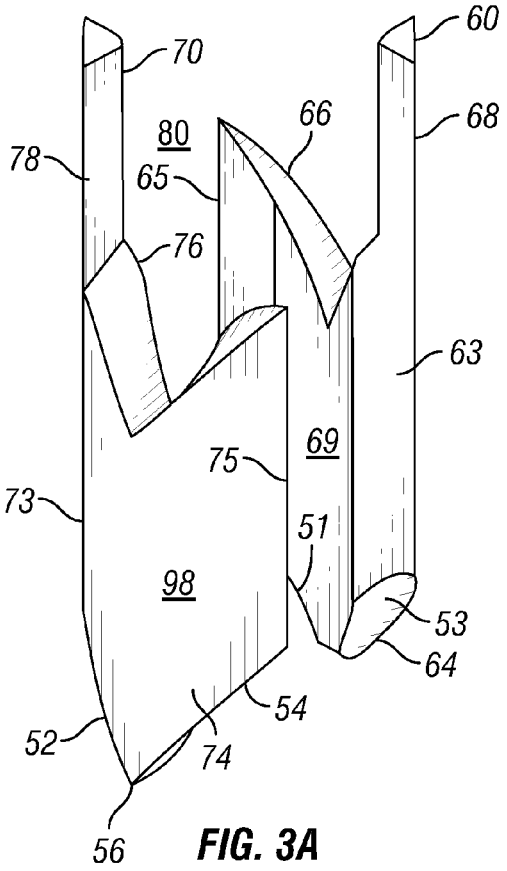
FIG. 3A is a perspective view of one specific embodiment of the first and second inserts for the fishing tools disclosed herein.
Figure 3B:
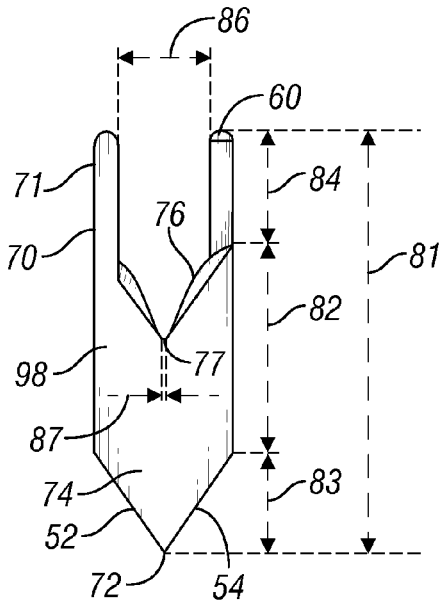
FIG. 3B is a side perspective view of the first and second inserts shown in FIG. 3A.
Figure 3C:
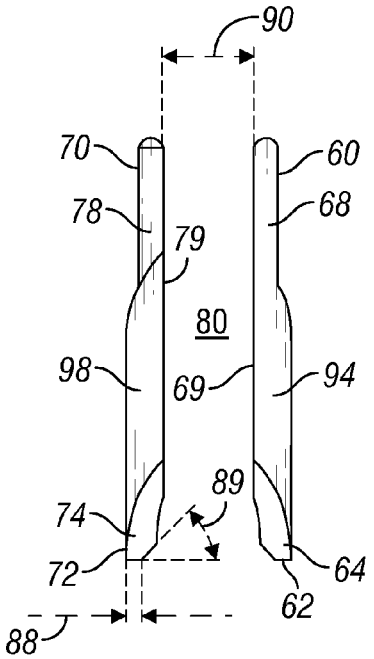
FIG. 3C is another side perspective view of the first and second inserts shown in FIG. 3A.
Figure 3D:
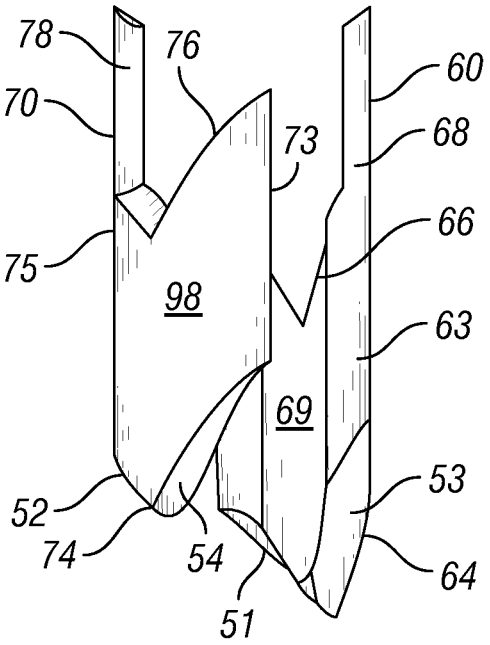
FIG. 3D is an additional perspective view of the first and second inserts shown in FIG. 3A.
Figure 3E:
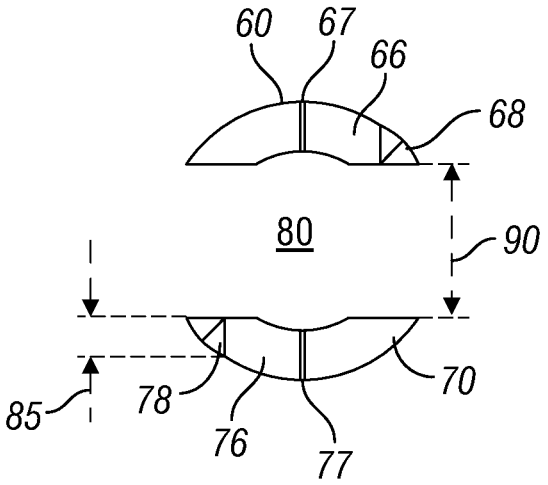
FIG. 3E is a top perspective view of the first and second inserts shown in FIG. 3A.

In one specific embodiment, inserts 60, 70 comprise the shapes and dimensions shown in FIGS. 3B, 3C, and 3E relating to inserts 60, 70, sides 63, 65, 73, 75, fishing profiles 66, 76, guides 64, 74, and release indicator elements 68, 78. In particular, inserts 60, 70 each comprise height 81, side height 82, guide height 83, release indicator element height 84, release indicator element width 85 (FIG. 3E), fishing profile width 86, and fishing profile valley width 87. Guides 64, 74 also comprise guide lower end thickness 88, and guide lower end profile angle 89 (both shown in FIG. 3C). In addition, pathway 80 comprises pathway width 90 (FIGS. 3C and 3E).

Height 81 can be in the range from approximately 16 inches to approximately 24 inches; side height 82 can be in the range from zero inches to approximately 12 inches; guide height 83 can be in the range from approximately 4 inches to approximately 6 inches; release indicator element height 84 can be in the range from approximately 4 inches to approximately 8 inches; release indicator element width 85 can be in the range from approximately 1.0 inch to approximately 1.5 inches; fishing profile width 86 can be in the range from approximately 4 inches to approximately 6 inches; fishing profile valley width 87 can be in the range from approximately 0.15 inches to approximately 0.25 inches; guide lower end thickness 88 can be in the range from approximately 0.5 inches to approximately 1.0 inch; guide lower end profile angle can be in the range from approximately 15 degrees to approximately 75 degrees; and pathway width 90 can be in the range from approximately 4 inches to approximately 6 inches. In one particular embodiment, height 81 is approximately 22 inches; side height 82 is approximately 10.8 inches; guide height 83 is approximately 5.2 inches; release indicator element height 84 is approximately 6.0 inches; release indicator element width 85 is approximately 1.25 inches; fishing profile width 86 is approximately 4.7 inches; fishing profile valley width 87 is approximately 0.2 inches; guide lower end thickness 88 is approximately 0.75 inches; guide lower end profile angle 89 is approximately 45 degrees; and pathway width 90 is approximately 4.75 inches. In another particular embodiment, height 81 is approximately 22 inches; side height 82 is approximately 11.3 inches; guide height 83 is approximately 4.7 inches; release indicator element height 84 is approximately 6.0 inches; release indicator element width 85 is approximately 1.0 inch; fishing profile width 86 is approximately 4.6 inches; fishing profile valley width 87 is approximately 0.3 inches; guide lower end thickness 88 is approximately 0.6 inches; guide lower end profile angle 89 is approximately 45 degrees; and pathway width 90 is approximately 4.75 inches.

Operation of one particular fishing tool disclosed herein involves securing a fishing tool as disclosed herein to a work string and running the fishing tool into a well until it reaches the fish, which may include a flared end. The fishing tool is then slacked off over the "fish" to allow a guide disposed at the lower end of a profiled surface or insert disposed along the inner wall surface of the tubular member of the fishing tool to contact the fish. In the case of a fish having a flared pipe end, the fishing tool is moved by the guide to a position where the flared profile lines up with a pathway disposed between the two profiled surfaces or inserts. Aligning the tool in this manner can be facilitated by rotation of the work string and, thus, the fishing tool.

Additional slack-off input into the work string allows the flared profile of the fist to travel up and through the pathway of the tool. Slacking-off of the work string continues until all of the flared geometry of the fish has passed completely through the fishing tool. At this point, the work string and, thus, fishing tool, is rotated 90 degrees in either the clockwise or counter-clockwise direction realigns the tool into the "catch" position. Alternatively, if the flared portion of the pipe has passed completely above the tool, 90 degrees of right-hand rotation of the work string and, thus, tool, be input to align the tool into the "catch" position.

After the fishing tool is moved to the "catch" position, the fishing tool is picked up or moved upwards within the wellbore until the flared pipe engages the catch profile on the fishing tool. Pick-up of the fish can now be applied to move the fish within the wellbore and, if desired, completely remove the fish from the wellbore.

If it becomes necessary to release the fishing from the fish, slight right-hand torque can be held into the work string from surface while the fishing tool is slowly slacked-off. The flared pipe will exit the catch profile and engage the release indicator elements indicating that the flared pipe is again aligned with the pathway. Moving the fishing tool into the release position in this manner is preferable because several indications can be seen on surface confirming that the fishing tool is indeed lined up in the release position. These surface indications will be represented by surface torque readings decreasing slightly as the work string pipe turns 90 degrees toward the release position. With the flared pipe aligned with the pathway again, the tool can be picked up and released from the flared pipe of the fish.

Another method for aligning the flared pipe with the catch profile is to use an "Automatic-J" feature. Automatic-J features are known in the art. The benefit of the Automatic-J feature is that no input rotation is required to align the catch profile in the fishing tool with the flared pipe. The Automatic-J feature can be utilized by adding another guide above the tool that is oriented 90 degree relative to the guide on bottom. The Automatic-J feature allows for the option to engage the flared pipe by means of slack-off and pick-up input into the work string and, thus, fishing tool, without the need to rotate the work string or tubular member.

The fishing tool can be manufactured from a cylindrical piece of stock material by splitting the stock piece into two "half shell" inserts that are then shaped to the desired dimensions. These "half shell" inserts can then be plug welded or bolted inside of a tubular member such as a wash pipe extension. Another method for manufacturing the "half shell" inserts is by using a 4-axis or similar CNC machine. Additionally, a shoulder could be machined on the outside of the "half shell" inserts with a matching shoulder machined on the inner diameter of the wash pipe extension. Then, the "half shell" inserts could be plug welded or bolted to the tubular member. Alternatively, the profiles could be cut into a single piece of tubular member to provide maximum strength.

Figure 4A:
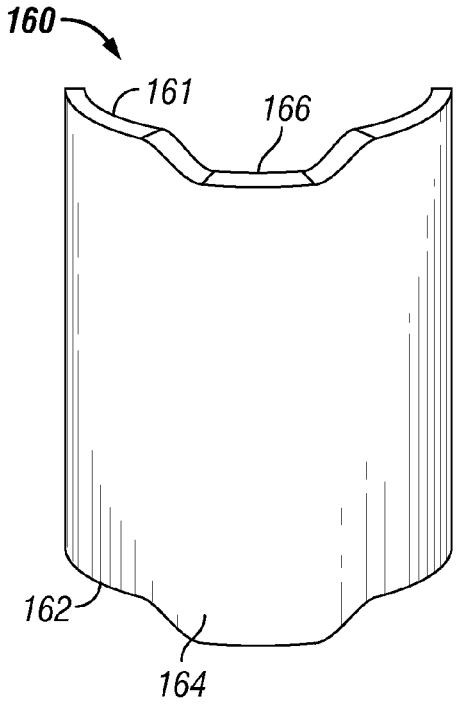
FIG. 4A is a perspective view of another specific embodiment of a first insert for the fishing tools disclosed herein.
Figure 4B:
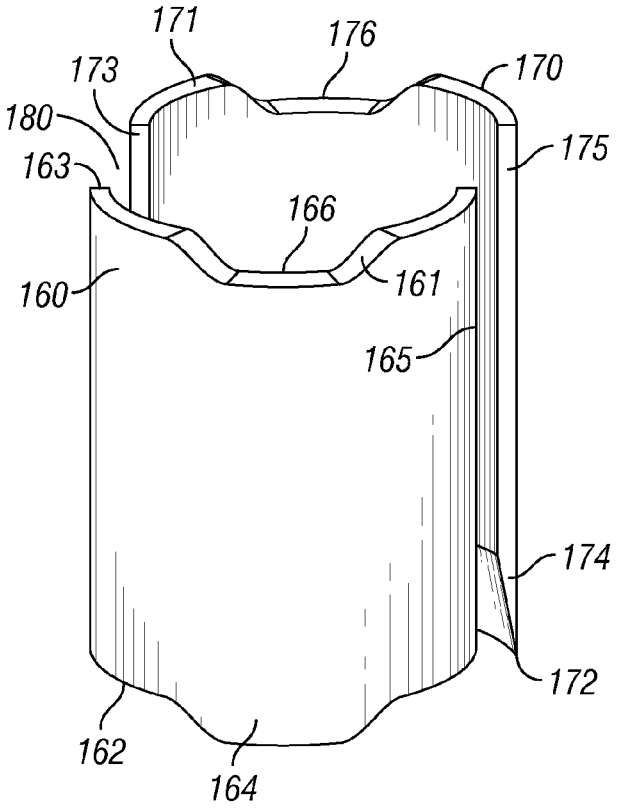
FIG. 4B is a perspective view of the first insert of FIG. 4A disposed relative to a second insert shown for the fishing tools disclosed herein.

Referring now to FIGS. 4A and 4B, in another embodiment, inserts 160, 170 comprise arcuate bodies comprising upper ends 161, 171 comprising fishing or catch profiles 166, 176, and lower ends 162, 172 comprising guides 164, 174. As shown in FIG. 4B, inserts 160, 170 are disposed relative to each other similar to inserts 60, 70 discussed in greater detail above to provide pathway 180 between first sides 163, 173, and second sides 165, 175. In the specific embodiment of FIGS. 4A, 4B, catch profiles 166, 176 each comprise a concave shape having a "U" shape.

Operation of a fishing tool comprising inserts 160, 170 is similar to the operation of fishing tool 10 discussed above with respect to the embodiments of FIGS. 1-3. After disposing inserts 160, 170 on an inner wall surface of a tubular member to provide a fishing tool, the fishing tool is lowered into a bore of a well until inserts 160, 170 contact an object or fish within the bore. Inserts 160, 170 are then orientated, such as through rotation of the fishing tool, so that the fish slides within pathway 180 until inserts 160, 170 are disposed below a portion of the fish that can be engaged with the shoulders forming catch profiles 166, 176. The fishing tool is then oriented, such as through rotation, so that catch profiles 166, 176 are disposed below the portion of the fish that can be engaged with the shoulders forming catch profiles 166, 176 and the fishing tool is moved upward to engage the fish. The fishing tool is continued to be moved upward causing the fish to move upward with the fishing tool.

It is to be understood that the invention is not limited to the exact details of construction, operation, exact materials, or embodiments shown and described, as modifications and equivalents will be apparent to one skilled in the art. For example, the two inserts or profiled surfaces do not have to be identical to each other in shape or size, nor do they have to have the specific dimensions disclosed herein. To the contrary, the size, shape, and dimensions of the inserts or profiled surfaces can be modified as desired or necessary to facilitate releasably securing the fish within the bore of the fishing tool. Moreover, different guide and catch profiles can be machined to allow only right hand or left hand rotation while guiding the fish, e.g., the flared pipe, through the fishing tool. Further, different catch profiles can be machined to accept different fish geometries. In addition, the outer diameter, inner diameter, and pathway width are all specific to the fishing geometry of the wellbore and fish, and can be customized depending on the situation. Additionally, in embodiments in which side height 82 is zero, lower ends 62, 72 of the arcuate bodies may be flush with lower end 22 of tubular member 20, or, alternatively, lower ends 62, 72 may extend below lower end 22 of tubular member 20. Accordingly, the invention is therefore to be limited only by the scope of the appended claims.

What is claimed is:

1. A downhole fishing tool for retrieving an object in a well, the downhole fishing tool comprising:

a tubular member having an upper end for attaching to a string for lowering the downhole fishing tool into a well, a tubular member bore defined by an inner wall surface, the inner wall surface having a fishing profile disposed thereon, the fishing profile comprising a first arcuate body having a first upper surface, a first lower surface, a first side, a second side, a first vertical stop extending from the first upper surface adjacent the first side, and a first inner wall surface, the first upper surface comprising a first shoulder disposed within the tubular member bore for engaging an object disposed within the well;

a second arcuate body having a second upper surface, a second lower surface, a first side, a second side, a second vertical stop extending from the second upper surface adjacent the first side, and a second inner wall surface, the second upper surface comprising a second shoulder disposed within the tubular member bore for engaging an object disposed within the well, the second arcuate body being disposed opposite the first arcuate body;

a first pathway disposed along the inner wall surface of the tubular member, the first pathway being disposed between the first side of the first arcuate body and the second side of the second arcuate body; and a second pathway disposed along the inner wall surface of the tubular member, the second pathway being disposed between the second side of the first arcuate body and the first side of the second arcuate body.

2. The downhole fishing tool of claim 1, wherein each of the first upper surface and the second arcuate upper surface comprise a concave shape.

3. The downhole fishing tool of claim 2, wherein the concave shape of each of the first upper surface and the second upper surface are V-shaped providing an angle in the range from about 60 degrees to about 90 degrees.

4. The downhole fishing tool of claim 3, wherein the first lower surface comprises first lower intersecting wall surfaces, the first lower intersecting wall surfaces intersecting each other at a first point, and the second lower surface comprises second lower intersecting wall surfaces, the second lower intersecting wall surfaces intersecting each other at a second point.

5. The downhole fishing tool of claim 4, wherein the first inner wall surface comprises a first radius of curvature and the second inner wall surface comprises a second radius of curvature.

6. The downhole fishing tool of claim 5, wherein the first radius of curvature is equal to the second radius of curvature.

7. The downhole fishing tool of claim 1, wherein the first arcuate body comprises a first insert secured to the inner wall surface of the tubular member and the second arcuate body comprises a second insert secured to the inner wall surface of the tubular member.

8. A downhole fishing tool for retrieving an object in a well, the downhole fishing tool comprising:

a tubular member having an upper end for attaching to a string for lowering the downhole fishing tool into a well, a tubular member bore defined by an inner wall surface, the inner wall surface having a fishing profile disposed thereon, the fishing profile comprising a first shoulder disposed along the inner wall surface, the first shoulder comprising a first end, a second end, a first concave shape opened toward the upper end, and a first vertical stop member extending upward from the first end of the first shoulder;

a second shoulder disposed along the inner wall surface, the second shoulder comprising a first end, a second end, a second concave shape opened toward the upper end, and a second vertical stop member extending upward from the first end of the second shoulder, the first shoulder and second shoulder being disposed opposite each other along the inner wall surface thereby defining first and second longitudinal pathways along the inner wall surface of the tubular member between the first and second shoulders, wherein the first end of the first shoulder is disposed opposite the second end of the second shoulder.

9. The downhole fishing tool of claim 8, wherein the first and second shoulders each comprise a lower end, each of the lower ends comprising two lower end surfaces intersecting each other at a point.

10. The downhole fishing tool of claim 8, wherein the first shoulder comprises a first shoulder insert secured to the inner wall surface of the tubular member and the second shoulder comprises a second insert secured to the inner wall surface of the tubular member.

11. The downhole fishing tool of claim 10, wherein the first concave shape comprises a V-shaped providing an angle in the range from about 60 degrees to about 90 degrees.

12. The downhole fishing tool of claim 10, wherein the first concave shape comprises a U-shape.

13. The downhole fishing tool of claim 10, wherein the first shoulder insert comprises a first insert shape having a first set of dimensions and the second shoulder insert comprises a second insert shape having a second set of dimensions, the first insert shape being identical to the second insert shape.

14. A method of retrieving an object disposed in a bore of a well, the method comprising the steps of:

(a) running a downhole fishing tool into a well, the downhole fishing tool comprising a tubular member having an upper end for attaching to a string for lowering the downhole fishing tool into a well, a tubular member bore defined by an inner wall surface, the inner wall surface having a fishing profile disposed thereon, the fishing profile comprising a first arcuate body having a first upper surface, a first lower surface, and a first inner wall surface, the first upper surface comprising a first shoulder disposed within the tubular member bore for engaging an object disposed within the well and a first vertical stop member extending upward from the first end of the first shoulder;

a second arcuate body having a second upper surface, a second lower surface, and a second inner wall surface, the second upper surface comprising a second shoulder disposed within the tubular member bore for engaging the object disposed within the well and a second vertical stop member extending upward from the first end of the second shoulder, the second arcuate body being disposed opposite the first arcuate body;

a first pathway disposed along the inner wall surface of the tubular member, the first pathway being disposed between the first side of the first arcuate body and the second side of the second arcuate body; and a second pathway disposed along the inner wall surface of the tubular member, the second pathway being disposed between the second side of the first arcuate body and the first side of the second arcuate body;

(b) lowering the tubular member bore over the object;

(c) rotating the tubular member in a first direction to dispose a first portion of the object above the first upper surface and to dispose a second portion of the fish above the second upper surface;

(d) moving the tubular member upward to engage the object with the first and second upper surfaces; and (e) continuing to move the tubular member upward to move the object upward within the bore of the well.

15. The method of claim 14, further comprising the steps of:

(f) rotating the tubular member in the first direction to align with the first pathway the first portion of the object previously disposed above the first upper surface and to align with the second pathway the second portion of the object previously disposed above the second upper surface causing the object to be released from the downhole fishing tool; and (g) moving the tubular member upward.

16. The method of claim 15, wherein during step (f) the object is contacted with the first vertical stop member thereby indicating when the object is positioned for release.

17. The method of claim 16, wherein during step (f) the object is contacted with the second vertical stop member thereby indicating when the object is positioned for release.

* * * * *